US005436433A

United States Patent [19]

Kim et al.

[11] Patent Number: 5,436,433

[45] Date of Patent: Jul. 25, 1995

[54] AUTOMATIC THAWING DEVICE OF MICROWAVE OVEN AND CONTROL METHOD THEREOF

[75] Inventors: Seog T. Kim; Chun S. Gong; Eun S. Chai, all of Kyungsangnam, Rep. of Korea

[73] Assignee: Goldstar Co., Ltd., Seoul, Rep. of Korea

[21] Appl. No.: 177,864

[22] Filed: Jan. 4, 1994

[30] Foreign Application Priority Data

Mar. 19, 1993 [KR] Rep. of Korea ..... 4226/1993
Aug. 6, 1993 [KR] Rep. of Korea ..... 15287/1993

[51] Int. Cl.[6] ..... H05B 6/68

[52] U.S. Cl. ..... 219/703; 219/707; 99/325; 426/243

[58] Field of Search ..... 219/703, 707, 710, 711; 9/325; 426/243, 524

[56] References Cited

U.S. PATENT DOCUMENTS

| | | | |
|---|---|---|---|
| 4,255,639 | 3/1981 | Kawabata et al. | 219/703 |
| 4,453,066 | 6/1984 | Moki | 219/703 |
| 4,599,503 | 7/1986 | Ueda | 219/703 |
| 4,841,111 | 6/1989 | Kokkeler et al. | 219/703 |
| 4,874,914 | 10/1989 | Eke | 219/703 |
| 4,998,001 | 3/1991 | Cigarini et al. | 219/703 |

FOREIGN PATENT DOCUMENTS

| | | | |
|---|---|---|---|
| 166997 | 1/1986 | European Pat. Off. . | |
| 268329 | 5/1988 | European Pat. Off. . | |
| 63-226541 | 9/1988 | Japan | 219/703 |

*Primary Examiner*—Philip H. Leung

[57] ABSTRACT

An automatic thawing device of a microwave oven and a method for control thereof. A turntable is rotatably placed in a cooking chamber. A gas sensor is placed about an exhaust port of the oven and senses amount of gas or vapor exhausted from the cooking chamber through the exhaust port during a thawing operation, and outputs a gas amount signal to a microprocessor. The microprocessor calculates a thawing time by operation of the output signal of the gas sensor an outputting a thawing control signal for driving the microwave oven. An output drive unit controls output level of electromagnetic wave of high frequency of a magnetron in accordance with the thawing control signal of the microprocessor. The magnetron generates the electromagnetic wave of high frequency in accordance with output signal of the drive unit for the thawing time. A power source supplies an electric power to the thawing device in accordance with the thawing control signal of the microprocessor.

6 Claims, 7 Drawing Sheets

| MATERIALS | TEMP. | 915MHz / sec | | 2450MHz/sec | |
|---|---|---|---|---|---|
| | | HALF REDUCTION DEPth D(cm) | LOSS COEFFICIENT εr tanδ | HALF REDUCTION DEPth D(cm) | LOSS COEFFICIENT εr tanδ |
| WATER | -12.0 | 1500 | SMALL | 780 | VERY SMALL |
| | 14.5 | 6.6 | 7 | 0.2 | 17 |
| | 55.0 | 16.3 | 3 | 2.3 | 7 |
| | 95.0 | 29.5 | 2 | 4.8 | 4.5 |
| BEEF | 4.5 | 1.12 | 70 | 182 | 4 |
| | -17.7 | 9.8 | – | 76 | – |
| | -51.1 | 70.0 | SMALL | 460 | SMALL |
| FROZEN & DRIED BEEF | 17.7 | 550.0 | VERY SMALL | 190.0 | VERY SMALL |
| | -60.0 | 180.0 | VERY SMALL | 64.0 | SMALL |
| 0.1mol NaCl SOLUTION SUET | – | SMALL | 67 | SMALL | 34 |
| | – | SMALL | 11 | SMALL | 7 |
| POLYETHYLENE | – | VERY LARGE | 0.02 | VERY LARGE | 0.02 |
| TEFLON | – | VERY LARGE | 0.02 | VERY LARGE | 0.02 |

FIG. 7

| | TEN °C | SPECIFIC INDUCTIVE CAPACITY $\varepsilon_r$ | DIELECTRIC LOSS ANGLE $\tan\delta$ | DIELECTRIC LOSS COEFFICIENT $\varepsilon_r \tan\delta$ |
|---|---|---|---|---|
| WATER | 5 | 80.2 | 0.275 | 22.0 |
| ICE | -12 | 3.2 | 0.0009 | 0.000 28 |
| RAW BEEF | -15 | 5 | 0.15 | 0.75 |
| BEEF | 23 | 28 | 0.2 | 5.6 |
| RAW PORK | -15 | 6.8 | 1.2 | 8.15 |
| PORK | 35 | 23.0 | 2.4 | 57.5 |
| PEA | -15 | 2.5 | 0.2 | 0.5 |
| | 23 | 9.0 | 0.5 | 4.5 |
| BOILED POTATO | -15 | 4.5 | 0.2 | 0.9 |
| | 23 | 38.0 | 0.3 | 11.4 |
| SPINACH | -15 | 13.0 | 0.5 | 6.5 |
| | 23 | 34.0 | 0.8 | 27.2 |

AUTOMATIC THAWING DEVICE OF MICROWAVE OVEN AND CONTROL METHOD THEREOF

BACKGROUND OF THE INVENTION

1. Field of the Invention

The present invention relates in general to a microwave oven and, more particularly, to an automatic thawing device of the microwave oven and a method for controlling the automatic thawing operation of the device.

2. Description of the Prior Art

A microwave oven is generally provided with an automatic thawing function for thawing of frozen food. The automatic thawing operation of the microwave oven is carried out by an automatic thawing device.

With reference to FIG. 1, there is shown in a block diagram a construction of a typical automatic thawing device of a microwave oven. The typical thawing device comprises a turntable 3 which is placed in a cooking chamber 1 of the microwave oven and rotates with frozen food 2 loaded thereon, thus to render the food 2 appropriately thawed. A weight sensor 4 is mounted under the turntable 3 and senses the weight of the food 2 loaded on the turntable 3. This weight sensor 4 is connected to a microprocessor 5 and outputs a food weight signal to this microprocessor 5. The microprocessor 5 calculates a thawing time, required to thaw the frozen food 2, by operation of the weight signal of the sensor 4 and outputs a thawing control signal for driving the microwave oven. This microprocessor 5 is connected to a time display 6 which displays the thawing time thereon in response to the thawing control signal of the microprocessor 5. An output drive unit 7 is connected to the microprocessor 5 and outputs a drive signal in response to the thawing control signal of the microprocessor 5, thus to drive a magnetron 8 of the oven. This magnetron 8 generates an electromagnetic wave of high frequency or a microwave for the thawing time calculated by the microprocessor 5.

In FIG. 1, the reference numeral 9 denotes an exhaust port for exhausting vapor or gas generated from the food 2 in the cooking chamber 1 to the outside of the oven.

FIG. 2 is a flowchart of a method for control of the thawing operation of the above thawing device.

When the frozen food 2 is loaded on the turntable 3 in the cooking chamber 1 in order to be automatically thawed, the weight sensor 4 under the turntable 3 senses weight of the food 2. Upon sensing the food weight, the sensor 4 outputs the food weight signal to the microprocessor 5 where the weight signal is operated in order to calculate the thawing time required in thaw of the frozen food 2.

The microprocessor 5 in turn outputs the thawing control signal to both the time display 6 and the output drive unit 7. Upon reception of the thawing control signal, the time display 6 displays the thawing time thereon while the drive unit 7 outputs a signal for driving the magnetron 8. Accordingly, the magnetron 8 is oscillated and generates the electromagnetic wave of high frequency for the thawing time calculated by the microprocessor 5, thus to thaw the frozen food 2 in the rotating turntable 3. If briefly described, the typical thawing device calculates the thawing time in accordance with weight of frozen food and generates the electromagnetic wave of high frequency for the calculated thawing time, thus to thaw the frozen food.

The method for control of the frozen food thawing operation of the typical thawing device will be described in detail with reference to the flowchart of FIG. 2.

First, it is checked whether an automatic thawing key of a control panel was pushed in order to select an automatic thawing function. When the automatic thawing key has not been pushed, another function of the microwave oven is carried out. However, when the automatic thawing key was pushed, it is checked whether a food weight signal of the weight sensor 4 has been inputted. When the weight signal has been inputted, the weight signal is operated in order to calculate the thawing time for the frozen food 2. Here, the thawing time $T_R$ results from addition of 1 to a result of multiply of the food weight W to 0.6, that is, the thawing time $T_R$ is represented by the following equation.

$$T_R(min.)=(W\times 0.6)+1.$$

When the thawing time is calculated by the above operation of the food weight signal, it is checked whether a door of the microwave oven has been closed. When the door has been closed, a relay (not shown) is turned on in order to start the desired thawing operation by oscillating the magnetron 8 for the thawing time. However, when the door is not closed, a continued function is carried out.

As described above, the typical automatic thawing device senses weight of frozen food and calculates an appropriate thawing time by operation of food weight signal using a preset experimental data. This typical automatic thawing device and the control method thereof is disclosed in, for example, Korean Patent Laid-open Publication No. 92-1987 and Korean U. M. Publication No. 89-6080.

However, the above thawing device and its control method have a problem that the weight sensor should be provided in the device for sensing the food weight in the thawing operation, thus to increase cost due to its expense and to cause fraction defective due to its structural complexity. The mounting of the weight sensor under the turntable is also attended with a complex mounting structure, thus to deteriorate reliability of the microwave oven.

Since the typical automatic thawing device and its control method carry out the thawing operation only in accordance with sensed weight of the frozen food regardless of kind and frozen level of the food to be thawed, the frozen food may be slightly cooked or deficiently thawed. Furthermore, when the frozen food with a dish is unconsciously loaded on the turntable, the device carries out the thawing operation for an excessive time calculated on the basis of the total weight of both the food and the dish, thus to slightly cook the food and to deteriorate the reliability of the microwave oven.

SUMMARY OF THE INVENTION

It is, therefore, an object of the present invention to provide an automatic thawing device of a microwave oven in which the aforementioned problems can be overcome and which includes a temperature sensor, a humidity sensor or a gas sensor for sensing gas or vapor generated by a frozen food and controls output level of electromagnetic wave of a magnetron in response to the output signal of the above sensor, thus to automatically appropriately thaw the frozen food.

It is another object of the present invention to provide a method for control of thawing operation of the automatic thawing device.

In an aspect, the present invention provides an automatic thawing device of a microwave oven comprising: a turntable rotatably placed in a cooking chamber of the microwave oven and rotating with frozen food loaded thereon in order to evenly thaw the frozen food; a gas sensor placed about an exhaust port of the oven and sensing amount of gas or vapor exhausted from the cooking chamber through the exhaust port during a thawing operation, and outputting a gas amount signal to a microprocessor; the microprocessor calculating a thawing time by operation of the output signal of the gas sensor and outputting a thawing control signal for driving the microwave oven; an output drive unit controlling output of electromagnetic wave of high frequency of a magnetron in accordance with the thawing control signal of the microprocessor; the magnetron generates the electromagnetic wave of high frequency in accordance with output signal of the drive unit for the thawing time; and a power source supplying an electric power to the thawing device in accordance with the thawing control signal of the microprocessor.

In another aspect, the present invention provides a method for control of an automatic thawing operation of a thawing device of a microwave oven comprising the steps of: a) checking whether an automatic thawing key was pushed in order to select an automatic thawing function; b) carrying out another function when the thawing key has not been pushed, however, starting the thawing operation when the automatic thawing key was pushed; c) comparing a gas amount signal level of a gas sensor with a preset level; and d) when the gas amount signal level of the gas sensor has reached the preset level, determining that a desired thawing has been achieved, and ending the thawing operation. The step c) further comprises the steps of: carrying out a first thawing operation by heating a predetermined amount of frozen food for a predetermined time; when the first thawing operation has been achieved, determining the amount and frozen level of the frozen food by checking resistance ratio of the gas amount signal of the gas sensor, and carrying out a second thawing operation using a lower level of electromagnetic wave; and carrying out a third thawing operation using a lowest level of electromagnetic wave when the gas amount signal level of the gas sensor has been varied by a predetermined level for a predetermined level.

BRIEF DESCRIPTION OF THE DRAWINGS

The above and other objects, features and other advantages of the present invention will be more clearly understood from the following detailed description taken in conjunction with the accompanying drawings, in which:

FIG. 7 is a table representing dielectric characteristics of varieties of foods of the present invention.

DESCRIPTION OF THE PREFERRED EMBODIMENTS

Figure 1:
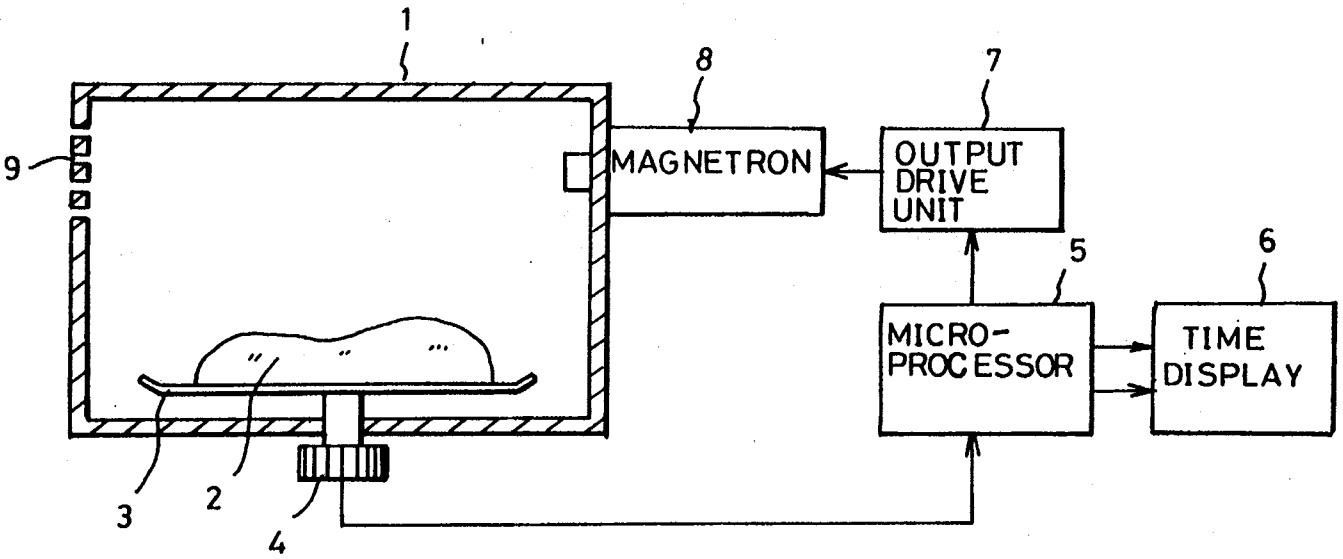
FIG. 1 CONVENTIONAL ART
FIG. 1 is a block diagram of a construction of a typical automatic thawing device of a microwave oven.
Figure 2:
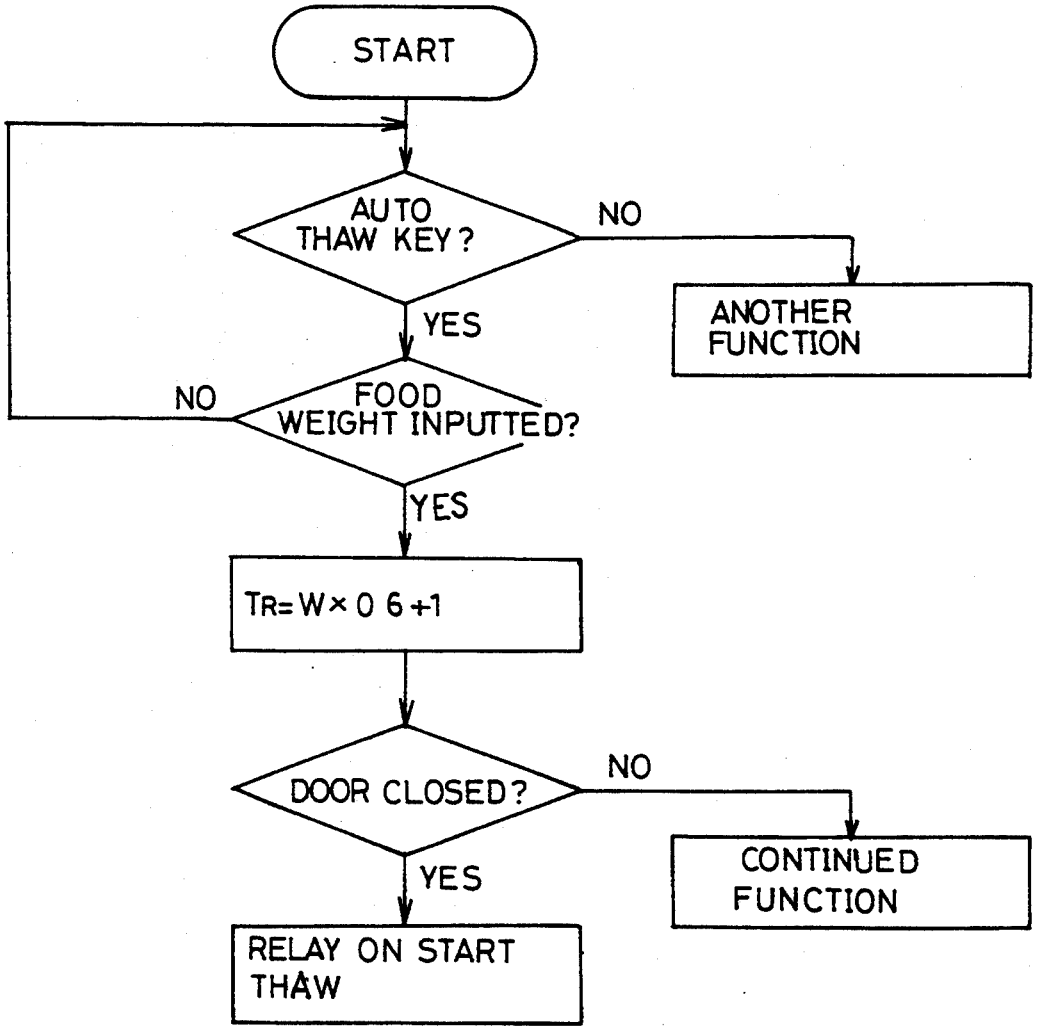
FIG.2 CONVENTIONAL ART
FIG. 2 is a flowchart of a method for control of an automatic thawing operation of the above typical thawing device.
Figure 3:
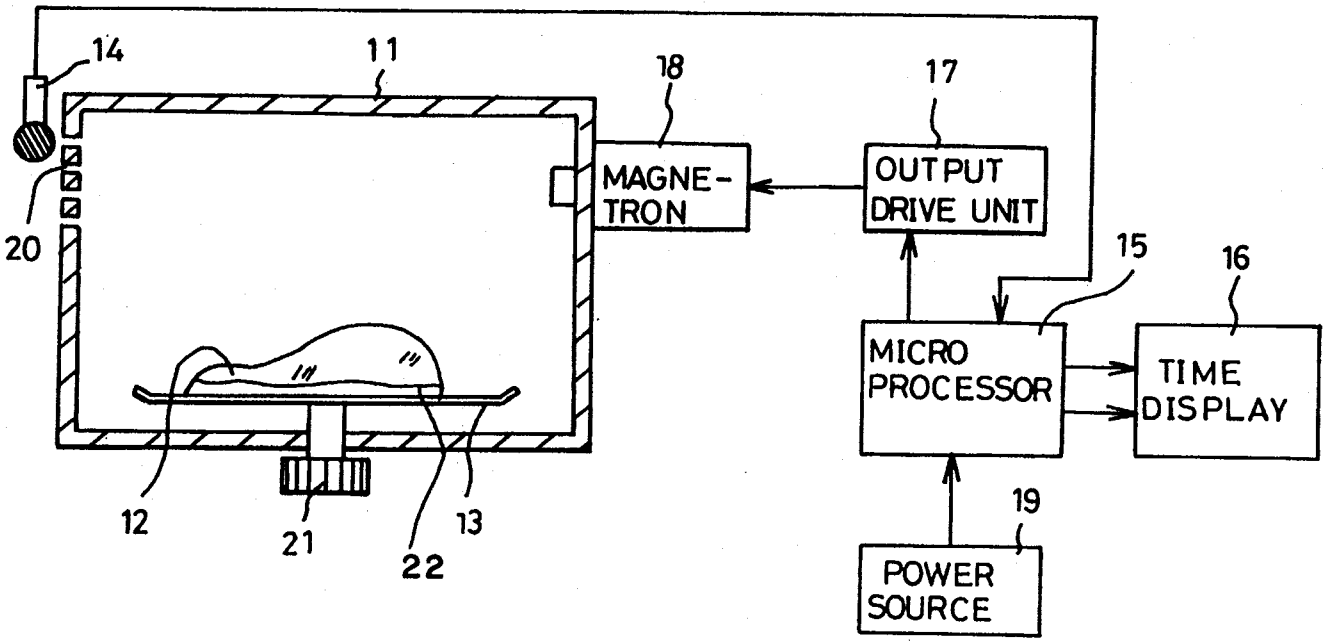
FIG. 3 is a block diagram of a construction of an automatic thawing device of a microwave oven in accordance with an embodiment of the present invention.

With reference to FIG. 3, there is shown a construction of an automatic thawing device of a microwave oven in accordance with an embodiment of the present invention. The thawing device comprises a turntable 13 which is placed in a cooking chamber 11 of the microwave oven and rotates with frozen food 12 loaded thereon, thus to render the food 12 appropriately thawed. A gas sensor 14 is placed about an exhaust port 20 of the oven and connected to a microprocessor 15. This gas sensor 14 senses gas amount exhausted from the cooking chamber 11 through the port 20 and outputs a gas amount signal to the microprocessor 15. The microprocessor 15 calculates a thawing time, required in thaw of the frozen food 12, by operation of the output signal or the gas amount signal of the gas sensor 14 and outputs a thawing control signal for driving the microwave oven. This microprocessor 15 is connected to a time display 16 which displays the thawing time thereon in response to the thawing control signal of the microprocessor 5. Of course, this time display 16 will display a cooking time during a cooking operation of the microwave oven. An output drive unit 17 is connected to the microprocessor 15 and controls output of electromagnetic wave of high frequency of a magnetron 18 in accordance with the thawing control signal of the microprocessor 15. This magnetron 18 is oscillated in accordance with output signal of the drive unit 17 and generates the electromagnetic wave of high frequency or a microwave for the thawing time calculated by the microprocessor 15. A power source 19 is connected to the microprocessor 15 and supplies an electric power to the device in accordance with the thawing control signal of the microprocessor 15.

In FIG. 3, the reference numeral 21 denotes a turntable motor for rotating the turntable 13.

The operational effect of the above thawing device will be given in conjunction with FIGS. 3 to 8.

When the thawing device is started while loading the frozen food 12 to be thawed on the turntable 13 in the cooking chamber 11, the drive unit 17 is driven and outputs the drive signal in response to the thawing control signal of the microprocessor 15. The output signal of the drive unit 17 is applied to the magnetron 18, thus to oscillate this magnetron. The magnetron 18 thus generates the electromagnetic wave which will be radiated to the frozen food 12 on the turntable 13.

Figures 5, 6:
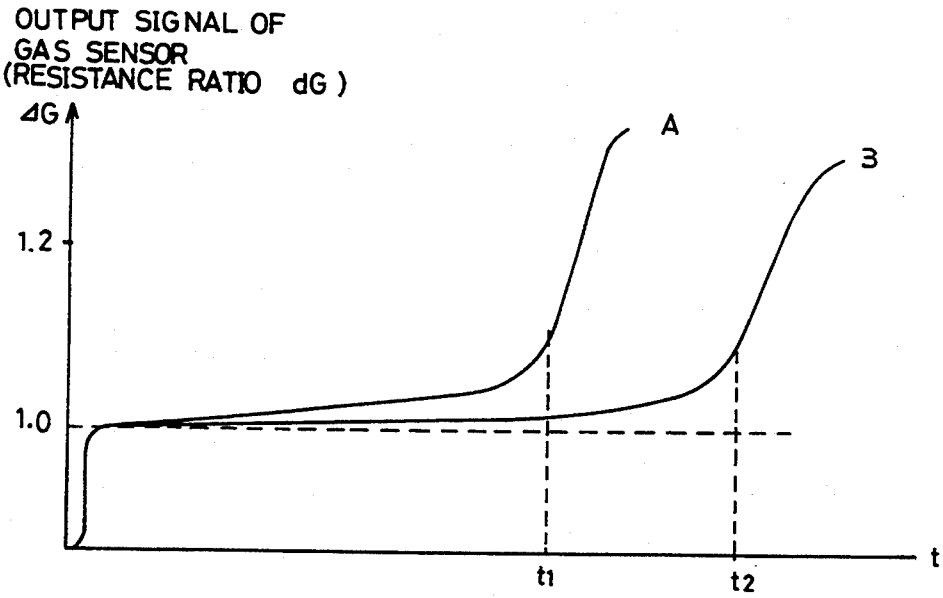
FIG. 5 is a graph showing the characteristic of an output signal (resistance ratio: dG) of a gas sensor of the device of FIG. 3 as a function of thawing time.
FIG. 6 is a table representing characteristics of electromagnetic waves radiated to varieties of materials of the present invention.

Conventionally, the electromagnetic wave has a characteristic in that it is transmitted through, absorbed by or reflected in foods in accordance with kinds of foods as represented in tables of FIGS. 6 and 7. When the electromagnetic wave is radiated to a frozen food, the quantity of incident wave is reduced to a half.

Figures 8A, 8B, 8C:
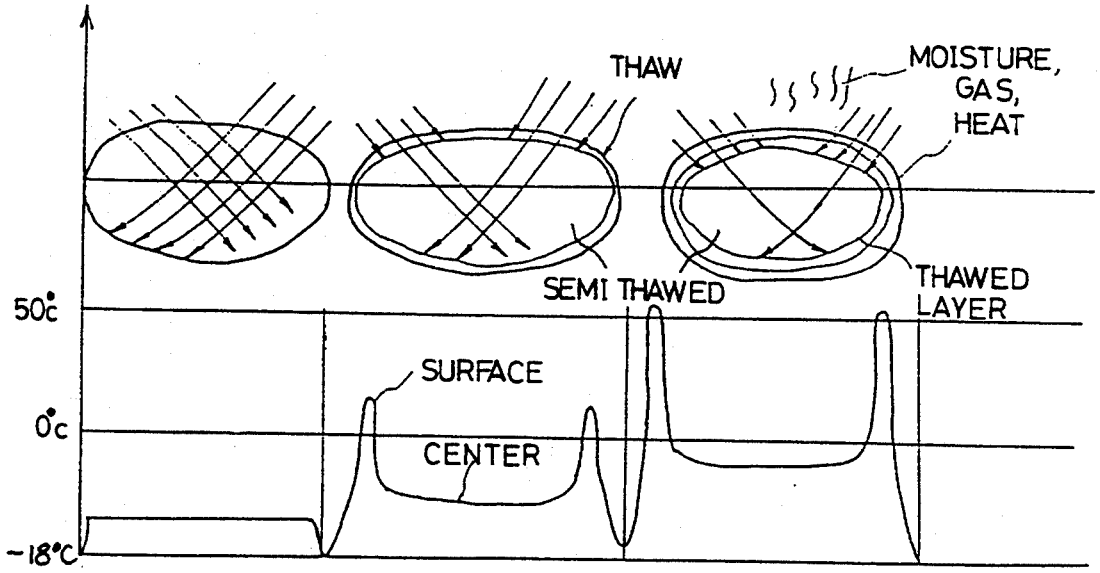
FIGS. 8A to 8C are views showing stepped states of a food automatically thawed by the thawing device of the present invention.

That is, when the frozen food 12 is heated by the electromagnetic wave, its frozen surface is first thawed as shown in FIG. 8A, thus to form a water layer on the whole surface of the food 12 as shown in FIG. 8B. At this state, the electromagnetic wave is absorbed by the water layer of the food 12 and evenly transmitted to the frozen internal section of the food 12.

When the water layer is formed on the whole surface of the food 12 as described above, the frozen internal section of the semi-thawed food 12 is evenly increased in its temperature by the electromagnetic wave absorbed by the water layer. In this case, the water layer of the food surface generates moisture, gas and heat, as shown in FIG. 8C, either of which is sensed by a sensor, that is, a humidity sensor, a gas sensor or a temperature sensor. In this embodiment, the sensor is the gas sensor 14 provided about the gas exhaust port 20.

The gas sensor 14 senses the gas amount generated from the water layer of the food 12 and outputs a gas amount signal (resistance ratio: dG) to the microprocessor 15. Upon reception of the output signal dG of the gas sensor 14, the microprocessor 15 checks the thawed state of the food 12. As represented in the graph of FIG. 5 showing the characteristic of the output signal dG of the sensor 14 as a function of thawing time, the output signal dG shows an inflection at a thawing time t1 or t2 when the frozen food 12 is somewhat thawed. This means that the electromagnetic wave is rapidly absorbed by the thawed section of the food 12 at that time t1 or t2, thus to accelerate generation of vapor or gas from the food 12.

As the output signal dG of the gas sensor 14 is applied to the microprocessor 15, this microprocessor 15 confirms the thawing point of the frozen food 12 or the inflection point t1 or t2 of the output signal dG of the gas sensor 14. Upon confirmation of the inflection point t1 or t2 of the signal dG, the microprocessor 15 ends the thawing operation of the automatic thawing device or reduces the output level of the electromagnetic wave of the magnetron 18 in order to carry out second or third thawing operation.

In the automatic thawing device of this invention, the third thawing operation is carried out for providing optimally thawed food regardless of frozen level, frozen state and weight of the food 12. In the graph of FIG. 5, the curves A and B denote thawing of the small amount of food and thawing of the large amount of food, respectively.

When the level of output signal dG of the gas sensor 14 reached a preset level, the microprocessor 15 determines that the desired thawing of the frozen food 12 is achieved and, thereafter, ends the thawing operation of the device. Here, the preset level is an experimentally set level of output signal of the gas sensor 14. This preset level is stored in the microprocessor 15 or in a memory at the outside of the microprocessor 15.

Figure 4:
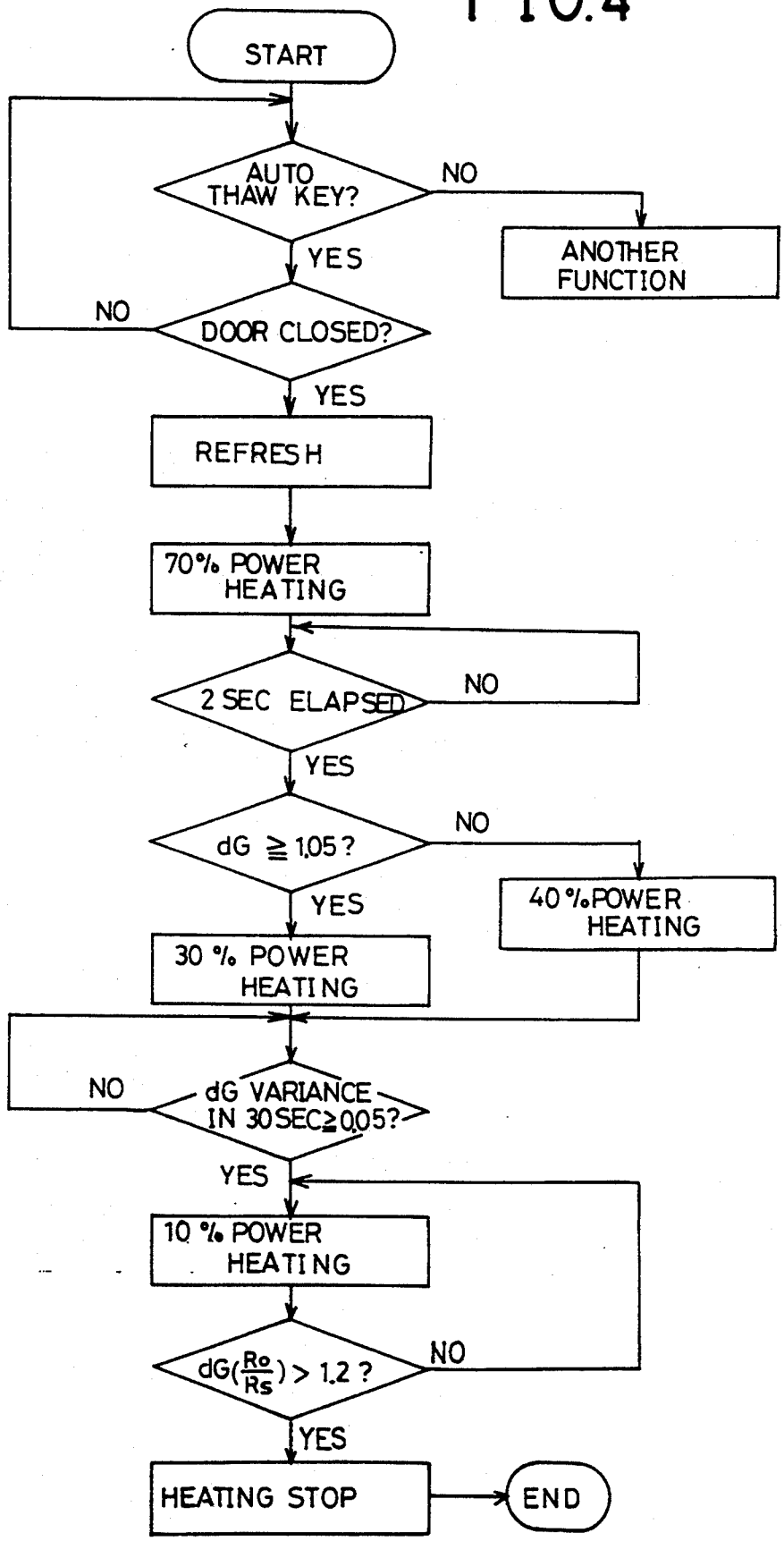
FIG. 4 is a flowchart of a method for control of an automatic thawing operation of the thawing device of the present invention.

Turning to FIG. 4, there is shown a flowchart of a method for control of the thawing operation of the above thawing device.

In order to automatically thaw the frozen food 12, an automatic thawing key (not shown) is pushed under the condition that the frozen food 12 is loaded on the turntable 13 in the cooking chamber 11. The microprocessor 15 outputs the thawing control signal to both the time display 16 and the output drive unit 17. Upon reception of the thawing control signal, the drive unit 17 outputs the drive signal to the magnetron 18. Accordingly, the magnetron 18 is oscillated and generates 70% of the electromagnetic wave for a predetermined time, thus to heat the frozen food 12.

Here, the above predetermined time, preset as about 2 mins., is a time until the frozen food 12 is somewhat thawed. The 70% of electromagnetic wave means that when letting the total heating time be 100 sec., the electromagnetic wave is outputted for 70 sec. by turning on relay, however, it is not outputted for remaining time 30 sec. by turning off relay.

When the vapor or gas is generated from the water layer of the food 12 since the first thawing operation for this food 12 is finished, the gas amount is sensed by the gas sensor 14. Upon sensing the gas amount, this gas sensor 14 outputs the gas amount signal dG to the microprocessor 15.

Upon reception of the output signal dG of the gas sensor 14, the microprocessor 15 compares the level of signal dG with the experimentally preset level and checks type of the frozen food 12.

That is, the microprocessor 15 determines that the food 12 is included in which of the two types, that is, first type: large amount of frozen food or small amount of excessively frozen food; and second type; small amount of frozen food or large amount of deficiently frozen food. The above determination of type of the food 12 is based on the gas amount sensed by the gas sensor 14.

In the case of first type food, this food generates the relatively smaller amount of gas, so that the output signal level of the sensor 14 is relatively lower. However, in the case of second type food, this food generates the relatively larger amount of gas, so that the output signal level of the sensor 14 is relatively higher.

When it is determined, in comparison of the signal levels, that the level of output signal dG of the sensor 14 is not less than a preset signal level, for example, 1.05, the second thawing operation for the food 12 is carried out. When the output signal level of the gas sensor 14 is less than 1.05, it is determined that the food 12 in the cooking chamber 11 is one of the first type, otherwise stated, this food 12 has a heavy weight not less than 500 g or is excessively frozen but has a light weight less than 500 g. Hence, the second thawing operation in this case is carried out using 40% of electromagnetic wave. However, when the output signal level of the sensor 14 is not less than the preset level 1.05, it is determined that the food 12 in the cooking chamber 11 is one of the second type, otherwise stated, this food 12 has a light weight less than 500 g or is deficiently frozen but has a heavy weight not less than 500 g. Hence, the second thawing operation in this case is carried out using 30% of electromagnetic wave.

In the present invention, the preset signal level is selected from 1.05, 1.02 and 1.00 while the output level of the electromagnetic wave is selected from 15%, 20%, 30% and 40% as desired.

When the output signal level of the gas sensor 14 has been varied by about 0.05 within 30 sec. in the above process, the microprocessor 15 determines that the desired thawing of the frozen food 12 is nearly achieved, thus to carry out the third thawing operation using 10% of electromagnetic wave.

Thereafter, when the output signal level of the gas sensor 14 has reached a preset thawing end level as a result of heating of the food 12 using the 10% of electromagnetic wave, the third thawing operation is ended.

If briefly described the control method of the automatic thawing operation with reference to the flowchart of FIG. 4, it is checked whether the automatic thawing key was pushed in order to select an automatic thawing function. When the automatic thawing key has not been pushed, another function of the microwave oven is carried out. However, when the automatic thawing key was pushed, refresh is carried out under the condition that the door of the microwave oven is closed. Thereafter, the first thawing operation, wherein the food 12 is heated by the 70% of electromagnetic wave of the magnetron 18, is carried out for a predetermined time of 2 min. When it is determined that the output signal level of the gas sensor 14 is not less than the preset level 1.05 after lapse of 2 min., the food 12 is regarded as small amount of food, so that the second thawing operation is carried out using 30% electromagnetic wave. However, when it is determined that the output signal level of the gas sensor 14 is less than the preset level 1.05 after lapse of 2 min., the food 12 is regarded as large amount of food, so that the second thawing operation is carried out using 40% electromagnetic wave. Thereafter, when the output signal level of the gas sensor 14 has been varied by about 0.05 within 30 sec., the microprocessor 15 determines that the desired thawing of the frozen food 12 is nearly achieved, thus to carry out the third thawing operation using 10% of electromagnetic wave. When the output signal level of the gas sensor 14 has reached the preset thawing end level 1.2 as a result of heating of the food 12 using the 10% of electromagnetic wave, the third thawing operation is ended.

In addition, the automatic thawing device of this invention preferably uses a thawing net provided on the turntable 13. Using the thawing net 22, the moisture of food drops under the thawing net 22 and vaporized by the electromagnetic wave, thus to generate vapor to gas. The gas amount generated by vaporization of the moisture gathered under the thawing net is sensed by the gas sensor 14, so that it is possible to sense a constant gas amount irrespective of partial heating of the food 12. In this regard, the reliability of the thawing device of this invention is improved.

As described above, the automatic thawing device of the microwave oven of the present invention carries out a first thawing operation using 70% of electromagnetic wave for a predetermined time and, thereafter, carries out a second thawing operation using lower level of power in accordance with variance of an output signal level of a gas sensor. Thereafter, the device carries out a third thawing operation using lowest level of power when it is determined from the variance of the output signal level of the sensor that the desired thawing of the food is nearly achieved. Hence, this thawing device provides optimally thawed food for the user. Since, the thawing device of this invention does not use expensive and complex weight sensor but use a simple temperature sensor, a humidity sensor or a gas sensor in optimal thaw of frozen food, this device reduces the cost, simplifies the construction and improves the reliability of the microwave oven.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. An automatic thawing device of a microwave oven comprising:

a turntable rotatably placed in a cooking chamber of the microwave oven and rotating with frozen food loaded thereon in order to evenly thaw the frozen food;

a gas sensor placed about an exhaust port of the oven for sensing an amount of gas or vapor exhausted from said cooking chamber through said exhaust port during a thawing operation, and outputting a gas amount signal to a microprocessor;

said microprocessor calculating a thawing time solely by operation of the output signal of said gas sensor and outputting a thawing control signal for driving the microwave oven;

an output drive unit controlling output of electromagnetic wave of high frequency of a magnetron in accordance with the thawing control signal of said microprocessor;

said magnetron generates the electromagnetic wave of high frequency in accordance with output signal of said drive unit for the thawing time;

a power source supplying an electric power to the thawing device in accordance with the thawing control signal of said microprocessor; and means for allowing moisture from the frozen food together under and spaced from the frozen food, so that said moisture is vaporized by said electromagnetic wave so that a constant amount signal is outputted from said gas sensor irrespective of partial heating of said frozen food.

2. The automatic thawing device according to claim 1, wherein said means is a thawing net provided on said turntable.

3. A method of controlling a thawing operation of an automatic thawing device of a microwave oven comprising the steps of:

a) checking whether an automatic thawing key was pushed in order to select an automatic thawing function;

b) carrying out another function when said thawing key has not been pushed, however, starting the thawing operation when said automatic thawing key was pushed;

c) comparing a gas amount signal level of a gas sensor with a preset level by;

(1) carrying out a first thawing operation by heating a predetermined amount of frozen food for a predetermined time, (2) determining the amount and frozen level of said frozen food by checking resistance ratio of said gas amount signal of the gas sensor, when said first thawing operation has been completed;

(3) carrying out a second thawing operation using a lower level of electromagnetic wave as compared to said first thawing operation, (4) carrying out a third thawing operation using a lower level of electromagnetic wave compared to said second thawing operation when said gas amount signal level of the gas sensor has been varied by a predetermined level for a predetermined time; and d) ending said thawing operation when said gas amount signal level of said gas sensor has reached said preset level, determining that a desired thawing has been achieved.

4. The method of claim 3, wherein said first thawing operation is performed by heating with 70 percent of electromagnetic wave of the magnetron.

5. The method of claim 4, wherein said second thawing operation is performed using a range of 15 to 40 percent of electromagnetic wave of a magnetron.

6. The method of claim 5, wherein said third thawing operation is performed using 10 percent of electromagnetic wave of a magnetron.

* * * * *